US007000518B2

(12) United States Patent
Bucks et al.

(10) Patent No.: US 7,000,518 B2
(45) **Date of Patent: *Feb. 21, 2006**

(54) APPARATUS FOR CUTTING FOOD PRODUCT

(75) Inventors: Brent Bucks, Valparaiso, IN (US); Daniel Wade King, Valparaiso, IN (US); Ralph Eugene Chester, Valparaiso, IN (US)

(73) Assignee: Urschel Laboratories, Inc., Valparaiso, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/250,113

(22) Filed: Jun. 4, 2003

(65) Prior Publication Data

US 2003/0221536 A1 Dec. 4, 2003

Related U.S. Application Data

(60) Provisional application No. 60/385,665, filed on Jun. 4, 2002.

(51) Int. Cl.
*B26D 7/06* (2006.01)

(52) U.S. Cl. ..... 83/402; 83/438; 83/444; 83/446; 83/665; 83/932

(58) Field of Classification Search ..... 83/665, 83/713, 719, 722, 723, 724, 932, 355, 356, 83/356.1, 356.2, 356.3, 22, 169, 402, 403, 83/418, 438, 444, 448, 449, 663; 241/92; 99/594, 595

See application file for complete search history.

(56) References Cited

U.S. PATENT DOCUMENTS

| | | | | | |
|---|---|---|---|---|---|
| 183,132 | A | * | 10/1876 | Clinton et al. | 241/92 X |
| 308,629 | A | * | 12/1884 | Reed | 83/356.3 X |
| 2,386,730 | A | * | 10/1945 | Weiner | 83/425.1 |
| 4,177,703 | A | * | 12/1979 | Cavier et al. | 83/356.3 |
| 4,198,887 | A | * | 4/1980 | Williams, Jr. | 83/356.3 |
| 4,523,505 | A | * | 6/1985 | Polson | 83/713 |
| 4,546,684 | A | * | 10/1985 | Bellerose | 241/92 X |
| 4,614,141 | A | * | 9/1986 | Mendenhall et al. | 83/402 |
| 4,644,838 | A | * | 2/1987 | Samson et al. | 83/865 |
| 5,410,929 | A | * | 5/1995 | Wallace | 83/160 |
| 5,450,777 | A | * | 9/1995 | Molnar et al. | 83/98 |

(Continued)

FOREIGN PATENT DOCUMENTS

JP 63-222038 * 9/1988

(Continued)

*Primary Examiner*—Clark F. Dexter
(74) *Attorney, Agent, or Firm*—Hartman & Hartman; Gary M. Hartman; Domenica N.S. Hartman

(57) ABSTRACT

An apparatus for cutting food product so that the product is properly oriented and stabilized before and throughout the cutting operation to produce a sliced product of uniform thickness, even if the delivered food product varies in shape and size, such as when both round and elongate potatoes are used to produce potato chips. The apparatus includes a cutting device and housing thereabove that defines a passage with an opening in proximity to the cutting device, such that food product is delivered to the cutting device in a substantially vertical direction. To improve the stability of round product during the cutting operation, the housing has an upper portion and a flared lower portion immediately below the upper portion so that at least a portion of the opening of the passage is defined by the flared region and has a larger radius of curvature than the upper portion.

22 Claims, 5 Drawing Sheets

U.S. PATENT DOCUMENTS

| | | | | | |
|---|---|---|---|---|---|
| 5,473,967 | A | * | 12/1995 | Frey et al. | 83/402 |
| 6,952,989 | B1 | * | 10/2005 | Bucks et al. | 83/703 |
| 2003/0145698 | A1 | * | 8/2003 | Bucks | 83/13 |
| 2004/0103798 | A1 | * | 6/2004 | Bucks et al. | 99/537 |

FOREIGN PATENT DOCUMENTS

| | | | |
|---|---|---|---|
| JP | 6-170784 | * | 6/1994 |
| NL | 1006794 | * | 5/1999 |

* cited by examiner

APPARATUS FOR CUTTING FOOD PRODUCT

CROSS REFERENCE TO RELATED APPLICATIONS

This application claims the benefit of U.S. Provisional Application No. 60/385,665, filed Jun. 4, 2002.

BACKGROUND OF INVENTION

1. Field of the Invention

The present invention generally relates to cutting methods and equipment. More particularly, this invention relates to an apparatus equipped with a cutting device having a horizontal cutting plane, and the apparatus delivers properly oriented and stabilized food product to the cutting device to produce a sliced product of uniform thickness.

2. Description of the Related Art

Many types of equipment are known to be used for slicing vegetables, specifically, root vegetables, and more specifically potatoes, into slices used to make potato chips. The most common machine used is the Urschel Model CCÂ® slicer. This slicer requires the use of abrasively peeled, substantially round potatoes in order to produce the desired round chip shape with a minimum amount of scrap.

It is desired by industry leaders to produce round potato chips from alternative potato varieties having an elongated shape as well as round varieties with a minimum of scrap. This ability would give the industry several advantages including the ability to use lower-cost raw products, greater consistency in chip shape, and improved process technologies. Urschel Laboratories, Inc. has developed and marketed new technology for processing to specifications similar to these using the TranSlicer 2000Â®apparatus and MicroSliceÂ® cutting wheel. However, industry leaders require additional abilities not available with existing machines, including running at 50–200 RPM without sacrificing the throughput attained in the original CC machine, reduced phase shifting when producing crinkled slices (chips having a corrugated shape when viewed edgewise) or V-slices (chips similar to crinkled but with relative sharp peaks and valleys when viewed edgewise), a reduction in tapered slices (slice thickness variation), and a reduction in scrap slices (pieces, shreds, miscuts, etc.) and other sources of product loss. In addition to the risk of jamming from foreign objects, there is also a concern for an increase in the occurrence of jamming and plugging as the potatoes are fed to the cutting wheel when attempting to produce chips from both elongated and round potato varieties. In making modifications to address the above concerns, another concern that may arise is the potential for damage to many costly components of a slicing machine as a result of small stones embedded in the food product.

SUMMARY OF INVENTION

The present invention provides an apparatus for cutting food products so that the product is properly oriented and stabilized before and throughout the cutting operation to produce a sliced product of uniform thickness. The apparatus is equipped with various features that improve the consistency of the sliced product, particularly if the delivered food product varies in shape and size, such as when both round and elongate potatoes are used to produce potato chips.

The apparatus of this invention is adapted to cut food products in a substantially horizontal plane, and as such comprises cutting means oriented to make a substantially horizontal cut through a food product. The apparatus further comprises a housing above the cutting means and defining a passage with an opening in proximity to the cutting means for delivering food products to the cutting means in a substantially vertical direction. According to one aspect of the invention that improves the stability of a round food product during the cutting operation, the housing has an upper portion and a flared lower portion immediately below the upper portion, with the lower portion having a lower extremity that defines the opening of the passage. The upper portion has a first wall region with a radius of curvature in a horizontal plane. The lower portion has a flared region along at least a circumferential portion thereof that is axially aligned with the first wall region of the upper portion. The flared region has a radius of curvature in a horizontal plane that increases in a direction away from the upper portion so that at least a portion of the opening of the passage is defined by the flared region and has a larger radius of curvature than the first wall region of the upper portion. The apparatus further includes means for applying a force on the food product traveling downward through the passage so as to urge the food product toward the flared region of the lower portion as the cutting means is making a cut through the food product. In combination with the force-applying means, the flared lower portion of the housing decreases the occurrence of jamming and plugging as round food products are fed through the passage to the cutting means.

In a preferred embodiment of the invention, the force-applying means comprises at least two converging fluid jets flowing across the housing passage toward the first wall region thereof so as to urge the food product toward the first wall region as the food product travels downward through the passage and as the cutting means is making a cut through the food product. According to another aspect of the invention that improves product stability during the cutting operation, an insert is positioned within the passage and adjacent the first wall region thereof so that the first wall region and the insert define a bypass flow region therebetween. In this manner, the insert spaces food products from the first wall region as the food product is urged toward the first wall region by the at least two fluid jets. The insert has at least one opening located therein so that fluid from one or more of the fluid jets enters the bypass flow region during conditions in which food product is not being impacted by the jet(s). In this manner, the fluid is inhibited from pushing the product away from the first wall region, which if allowed leads to product instability.

According to yet another aspect of the invention that improves the safety and maintenance of the apparatus, the housing is mounted to a moveable platform above the cutting means, and the cutting means comprises a hub having a vertical axis of rotation, blades extending radially from the hub, and means for supporting and rotating the hub about its vertical axis of rotation. Bearing means is present between the platform and the hub to permit rotation of the hub while under a load applied by the platform to clamp the bearing means therebetween, thereby clamping the hub to the supporting and rotating means. In this manner, the hub and its blades are not required to be secured with one or more fasteners to the supporting and rotating means, such that removal of the cutting means is greatly facilitated for purposes of replacement or repairs. In such an embodiment, the apparatus preferably further comprises a clutch assembly between the hub and the supporting and rotating means, by which the hub becomes mechanically disconnected from the supporting and rotating means if the hub is prevented from rotating at the same speed as the supporting and rotating means, such as when a large foreign object becomes jammed between the housing and the cutting means.

According to still another aspect of the invention that improves the consistency of the sliced product using blades with cutting edges adapted to produce a crinkled or V-slice cut through the food product, each of the blades has grooves that define the cutting edge, and the grooves have peaks that flatten in height and valleys that increase in depth in the plane of the blade in a direction away from the cutting edge. In this manner, phase alignment of the waves or V's of the product has been shown to be improved.

In view of the above, it can be seen that significant advantages made possible with this invention include improved product consistency and reduced risk of jamming and plugging when attempting to produce chips from both elongated and round potato varieties. In additional forms of the invention, the apparatus also facilitates the rapid removal of the cutting means and its components without the use of tools, and the cutting means is clutch-driven to reduce the risk of damage to the apparatus in the event that the cutting means suddenly stops or otherwise becomes jammed from food products or foreign objects.

Other objects and advantages of this invention will be better appreciated from the following detailed description.

DETAILED DESCRIPTION

Figure 1:
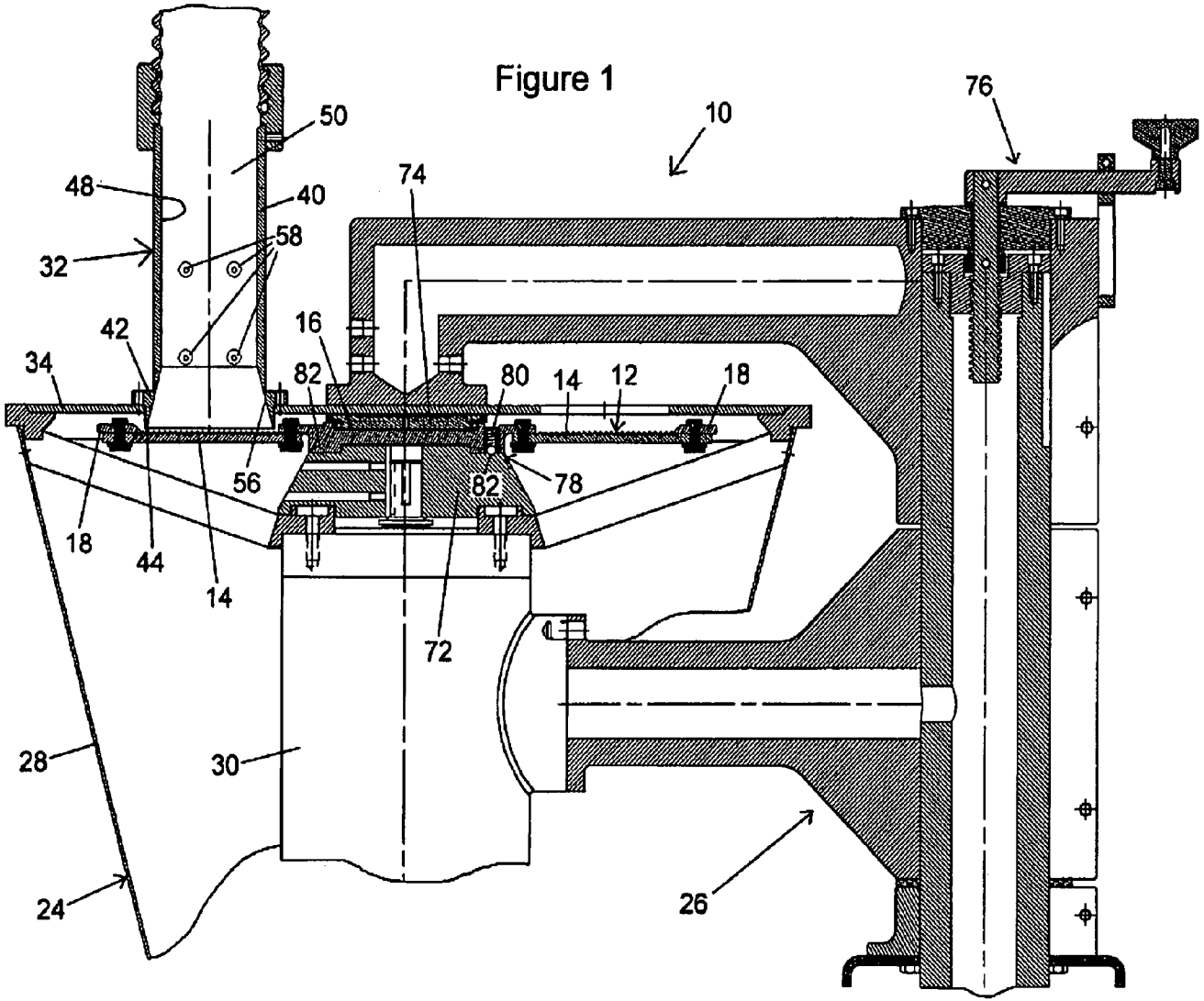
FIG. 1 is a side cross-sectional view of a portion of a slicing apparatus in accordance with the present invention, and shows a feed tube mounted to a platform that is clamped to an enclosure in which a cutting wheel is housed.
Figure 2:
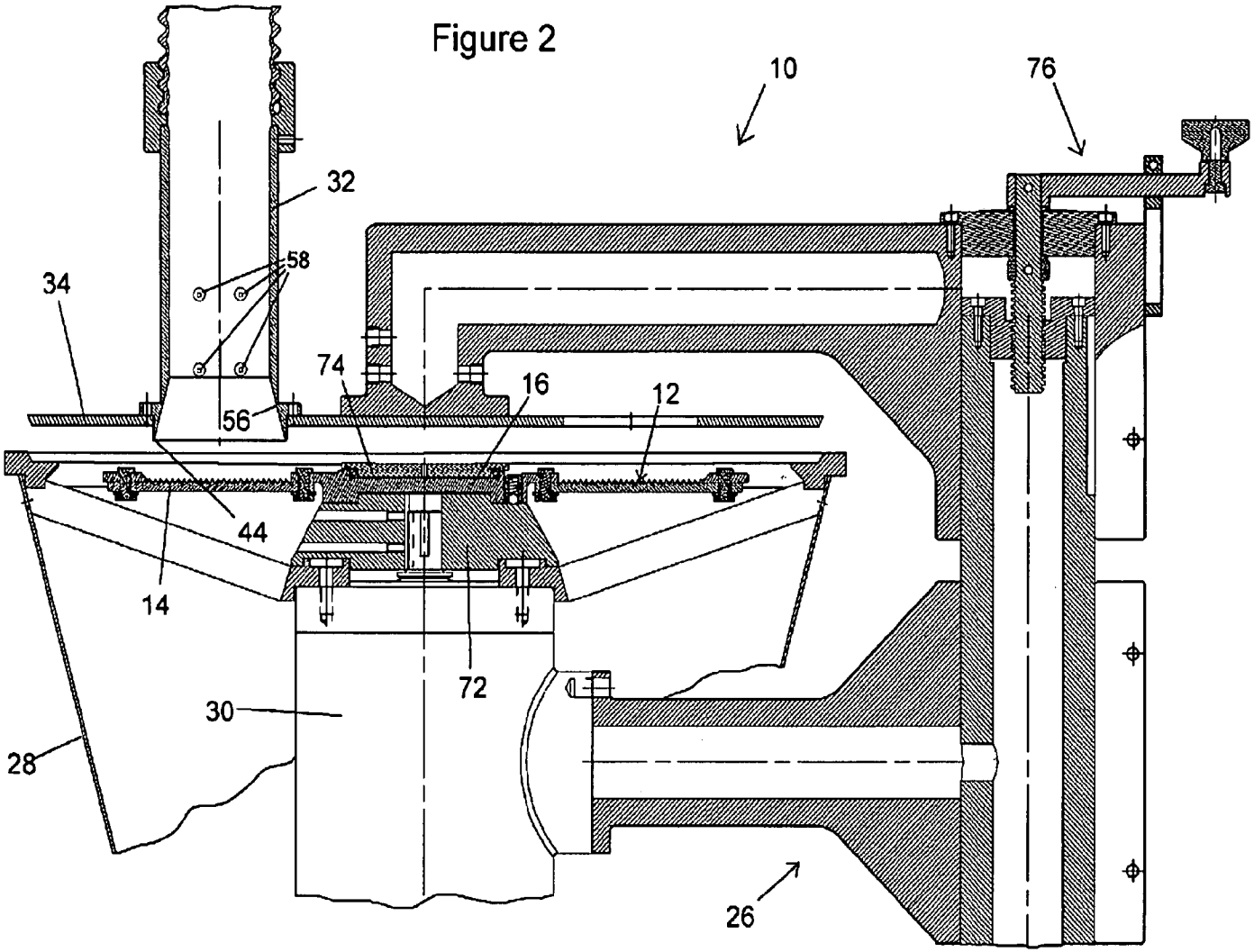
FIG. 2 shows a side view of the apparatus of FIG. 1, with the platform raised by a crank mechanism.
Figure 7:
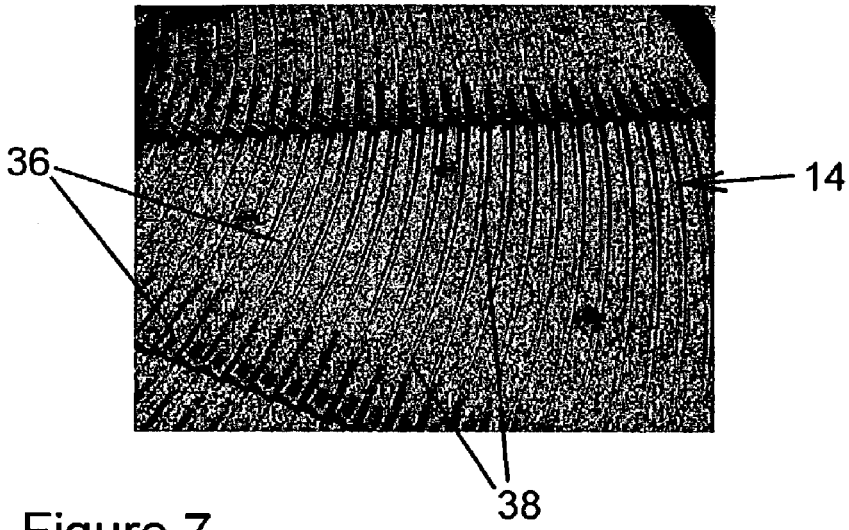
FIG. 7 is a scanned image of the upper surface of the cutting wheel of FIG. 1.
Figure 6:
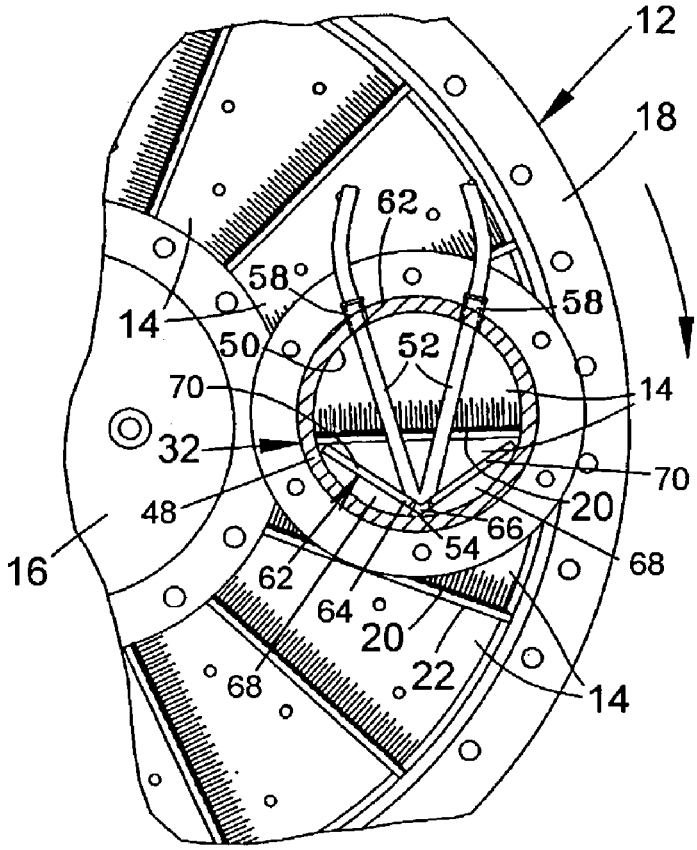
FIG. 6 is a partial plan view illustrating the relationship between the feed tube and cutting wheel of FIG. 1, wherein the feed tube is equipped with an insert.

FIGS. 1 and 2 depict a product delivery and slicing apparatus 10 equipped with a cutting wheel 12 oriented so as to produce a substantially horizontal cut through food products (not shown) delivered in a vertical direction from above the wheel 12. The cutting wheel 12 can be of various configurations, a preferred design being the MicrosliceÂ® cutting wheel disclosed in U.S. Pat. Nos. 5,992,284 and 6,148,709, which optionally may be modified in accordance with the following discussion. As depicted in FIGS. 1, 2, 6 and 7, the cutting wheel 12 can be seen to generally comprise a number of radially-extending blades 14 mounted between a hub 16 and an annular-shaped rim 18. In FIGS. 6 and 7, the blades 14 are seen as being closely spaced in the circumferential direction, with the cutting (leading) edge 20 of each blade 14 projecting above the trailing edge 22 of the preceding blade 14, thereby establishing the thickness of product slices (not shown) produced by the cutting wheel 12.

The blades 14 shown in the Figures are depicted as having V-shaped cutting edges 20 to produce V-slices with relative sharp peaks and valleys when viewed edgewise. Alternatively, the blades 14 could have flat cutting edges to produce flat slices, or corrugated cutting edges that produce crinkle slices, i.e., a corrugated or sinusoidal shape with more rounded peaks and valleys when viewed edgewise. If the blades 14 are equipped with corrugated or V-shaped cutting edges 20, the radial placement of each blade 14 relative to the preceding blade 14 will determine the appearance of the slices. If the peaks and valleys of the blades 14 are aligned, each peak on one surface of a slice will correspond to a valley on the opposite surface of the slice, such that the thickness of the slice is substantially uniform. However, if the peaks and valleys of the adjacent blades 14 are not aligned, the slices produced will be characterized by alternating thick and thin-walled sections (known as phase shift), and if sufficiently misaligned the product is shredded by the cutting wheel 12. Whether slices or shredded product are desired will depend on the intended use of the product. As will become apparent from the following discussion, the present invention enables the type of product desired to be accurately and reliably determined by the cutting wheel 12, instead of randomly determined by changes in the orientation of the product during the cutting operation.

While horizontal cutting wheels with vertical product delivery are known in the prior art, product orientation typically is of importance only if the slicing operation is to consistently produce very thin slices, e.g., on the order of about three mm or less, and a consistent peripheral shape is desired for the slices, such as a true cross-section of an elongated food product or a consistent diagonal (bias) slice through the product. Product stability also becomes critical if crinkled or V-slices are desired, because any rotation of the product about its vertical axis or lateral movement of the product (i.e., perpendicular to the product's vertical axis) will result in misalignment of the peaks and valleys in the opposite surfaces of the slices, resulting in a product having a crosshatched (lattice) appearance that may include patterns of holes if the slices are sufficiently thin. The slicing of elongate potatoes to produce round crinkle or V-slice chips is a primary example of these circumstances. However, round potatoes and other round food products have been found to present additional difficulties with stability, particularly in terms of the tendency for the product to become jammed during singulated vertical deliver and to roll during the cutting operation. Such issues are addressed with various features of the apparatus 10 of this invention.

The cutting wheel 12 is generally part of a slicing unit 24 supported by a frame 26. The slicing unit 24, shown with its interior visible in FIGS. 1 and 2, includes an enclosure 28 that contains the cutting wheel 12 and an internally-mounted electric motor 30 by which the wheel 12 is driven. The enclosure 28 defines a chute from whose lower end sliced food product exits the slicing unit 24. The frame 26 preferably houses the electrical wiring for powering the motor 30 and controls for operating the apparatus 10.

As evident from FIGS. 1 and 2, at least one (and preferably multiple) feed tube 32 is mounted to a platform 34 that is movable relative to the cutting wheel 12. Each feed tube 32 is sized and oriented to define a passage 50 that feeds food products (e.g., round and/or elongate potatoes) single-file in a substantially vertical direction (approximately normal) to the horizontal cutting wheel 12. While the feed tube 32 is shown as being oriented at about ninety degrees to a horizontal cutting surface (plane) defined by the cutting wheel 12, it is foreseeable that other orientations could be used, depending on the angle at which cuts are desired through the product. However, the cutting wheel 12 is preferably disposed in the horizontal plane, and the feed tube 32 is disposed at an angle of about fifteen to about ninety degrees, preferably about ninety degrees, to the cutting wheel 12. The apparatus 10 may make use of any suitable system to deliver the product to the feed tube 32, a preferred example being a conveyor and flexible tubes (a portion of which is shown in FIGS. 1 through 4) disclosed in copending and commonly-assigned U.S. patent application Ser. No. 10/072,494, incorporated herein by reference.

The cutting wheel 12 is preferably capable of being operated at variable speeds, with a preferred speed range of about 50 to about 200 rpm. The cutting wheel 12 is shown in FIG. 7 as having blades 14 configured to produce V-sliced product (characterized by relatively sharp peaks and valleys when viewed edgewise). As seen in FIG. 7, peaks 36 in the upper surface of each blade 14 gradually flatten and valleys 38 therebetween gradually taper deeper into the plane of the blade 14 in the direction approaching the following blade 14. According to the present invention, the groove configuration shown in FIG. 7 is able to improve the phase alignment of the peaks and valleys of a V-sliced product, thereby producing a sliced product with a more consistent thickness.

The feed tube 32 is depicted as having upper and lower portions 40 and 42 that together provide a complete enclosure for the food product as it is presented to the cutting wheel 12 through an opening 44 defined by the lower extremity of the passage 50. However, the feed tube 32 is not required to completely surround the product. Furthermore, the passage 50 is represented in the Figures (e.g., FIG. 6) as having a circular cross-sectional shape, though other shapes are possible, including square-shaped cross-sections. In further accordance with U.S. patent application Ser. No. 10/072,494, the feed tube 32 is preferably equipped with means for holding the product against a wall 48 of the tube 32. The means preferably comprises multiple jets 52 or 152 of water (or another suitable fluid), whose paths are schematically represented in FIGS. 1 through 6. As seen in FIG. 6, the jets 52 are discharged from nozzles 58 toward the wall 48 of the feed tube 32 opposite the side of the tube 32 from which the jets 52 are discharged. The water jets 52 and 152 are produced so as to be not greater than level and parallel to the cutting wheel 12, and preferably adjusted to be directed in a downward incline toward the cutting wheel 12 as seen in FIGS. 1 through 5.

According to one aspect of the invention, feed tubes 32 with a smooth interior (as depicted in FIGS. 1 through 3 and 5) have been determined to reduce jamming of food products, particularly round food products such as round potatoes. Furthermore, as shown in FIGS. 1 through 5, stability of food products within a feed tube 32 or 132 is enhanced by the presence of a tapered flared region 56 or 156 located within the lower portion 42 or 142 of the tube 32 or 132, as a result of the tapered flared region 56 or 156 acting to trap and center round potatoes against the cutting wheel 12, thereby reducing the incidence of tapered slices caused when the product rotates about an axis that is roughly parallel to the direction of the cut made by the cutting wheel 12. In the embodiment depicted in FIG. 3, the tapered region 56 has a continuous frustroconical shape throughout the lower portion 42 of the feed tube 32. The feed tube 132 of FIG. 4 has what may be termed a stepped (or ribbed) tapered flared region 156, such that the flared region 156 comprises axially-aligned circumferential surfaces having diametrical steps therebetween. A suitable taper angle for the flared regions 56 and 156 is about fifteen degrees from the axis of their passages 50 and 150, though greater and lesser angles are foreseeable. As a result of the flared regions 56 and 156, each passage 50 and 150 within the lower portions 42 and 142 of the feed tubes 32 and 132 has a radius of curvature in a horizontal plane that increases in the direction away from the upper portions 40 and 140 of the tubes 32 and 132, such that the tube openings 44 and 144 have larger diameters than the upper portions 40 and 140. For a passage 50 or 150 having a diameter of about three inches (about eight cm), suitable diameters for the passage openings 44 and 144 may be on the order of about four inches (about ten cm), though greater and lesser diameters are foreseeable. The openings 44 and 144 at the bottoms of the tube 32 and 132 may be asymmetrical as a result of their flared region 56 or 156 being formed on less than the entire diameter of the tube 32 or 132, i.e., limited to the circumferential region of the lower portion 42 or 142 below the wall 48 or 148 of the upper portion 40 or 140 opposite the water jets 52 and 152. In such an embodiment, the portions of the openings 44 and 144 defined by the flared regions 56 and 156 have a larger radius of curvature than the corresponding upper portions 40 and 140 of the feed tubes 32 and 132.

Figure 4:
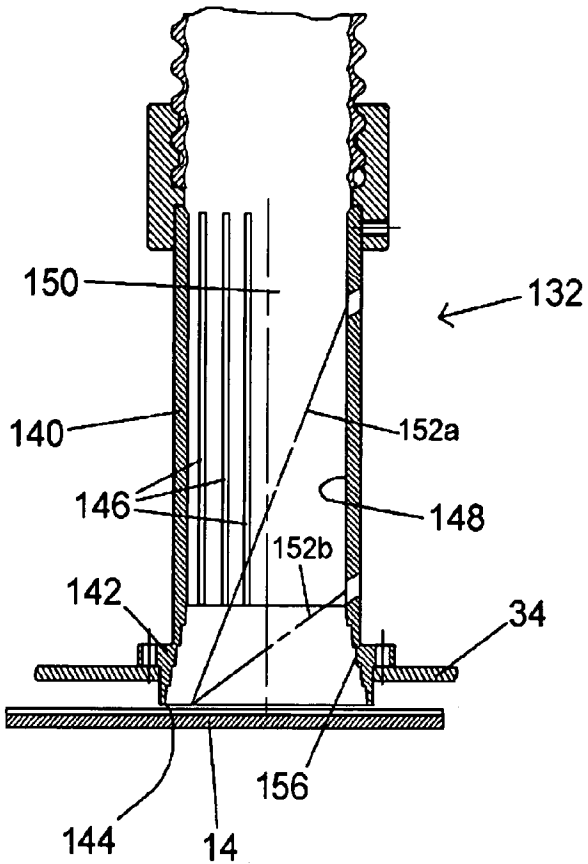
FIG. 4 is a cross-sectional side view of an alternative feed tube in accordance with the present invention.
Figure 3:
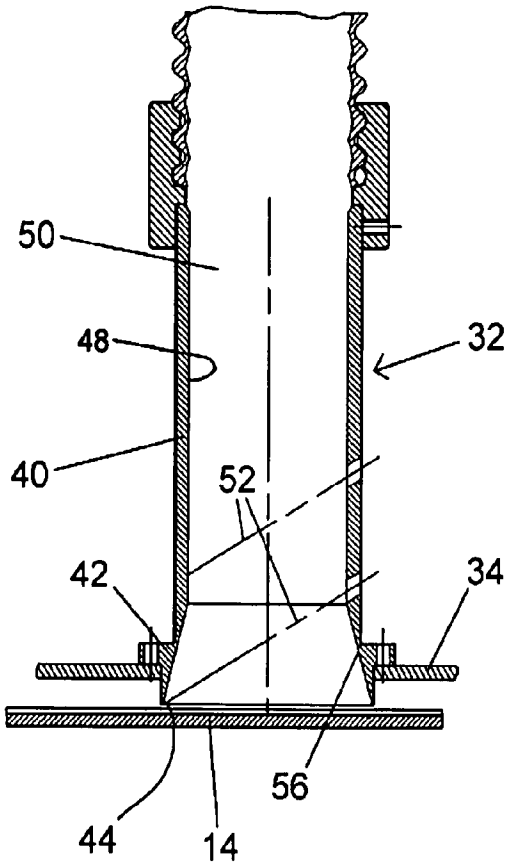
FIG. 3 is a cross-sectional side view of the feed tube of FIGS. 1 and 2.

The stepped configuration of the flared region 156 of FIG. 4 has been shown to be effective in reducing product roll, in which the product rotates about an axis that is roughly perpendicular to the surface of the cutting wheel 12, leading to what is termed a "phase shift" in V-slice and crinkled-slice chips. As such, a stepped tapered flared region 156 is believed to be a preferred aspect of this invention, particularly in combination with the water jet arrangement also depicted in FIG. 4. In particular, the feed tube 132 of FIG. 4 is equipped with an upper set of three substantially parallel jets 152*a*, and a lower pair of converging jets 152*b*. Both sets of jets 152*a* and 152*b* preferably impact the surface of the cutting wheel 12. As depicted in FIG. 4, both lower jets 152*b* and the center jet of the three parallel upper jets 152*a* preferably intersect and impact the cutting wheel 12 at a point ahead of the exit point 54 of the blades 14. The exit point 54 is generally located by a radius of the cutting wheel 12 that is tangent to the passage 50, and corresponds to where the trailing edges 22 of the blades 14 last pass beneath the opening 44 of the tube 32 as the wheel 12 rotates. The three parallel upper jets 152*a* are disposed at a smaller angle to the axis of the passage 150 than are the two lower jets 152*b*. The upper jets 152*a* are also preferably discharged at a higher nozzle pressure than the lower jets 152*b*, e.g., a nozzle pressure of about thirty to forty psi (about 2.1 to about 2.8 bar) as compared to about ten to fifteen psi (about 0.7 to about 1 bar) for the lower jets 152*b*.

According to U.S. patent application Ser. No. 10/072,494, a splined feed tube having an unflared opening has been determined to stabilize elongate food products. In accordance with an optional feature of the present invention that is also shown in FIG. 4, a feed tube 132 having a flared region 156 may also be equipped with vertical splines 146 formed on the wall 148 of the feed tube passage 150 against which the food product is held by the water jets 152. The splines 146 may have generally rectangular-shaped cross-sections as disclosed in U.S. patent application Ser. No. 10/072,494, or sawtooth cross-sections (not shown) that have been shown to increase resistance to product rotation in one direction, if such a problem is observed with a particular product or cutting operation. In addition to use on a feed tube 132 having a stepped tapered flared region 156 as shown in FIG. 4, splines 146 may be added to a feed tube 32 with a smooth tapered flared region 56 similar to that shown in FIGS. 1 through 3 and 5. The splines 146 are shown in FIG. 4 as not extending into the flared region 156 of the tube passage 150, though it is foreseeable that they could do so.

In a series of investigations leading to the present invention, raw, peeled round potatoes were fed through feed tubes of various configurations to a horizontal cutting wheel of the type shown in the Figures, yielding V-slice chips. Each feed tube had a three-inch interior diameter and one of the following configurations: unflared and splined (as disclosed in copending U.S. patent application Ser. No. 10/072,494); smooth-flared and unsplined (FIGS. 1 through 3); step-flared and splined (FIG. 4); step-flared and unsplined; smooth-flared and splined; and smooth (unflared and unsplined). Each tube was equipped with four water jets produced at 10 psi in accordance with U.S. patent application Ser. No. 10/072,494. The weight percentage of chips produced to have a tapered thickness or a phase shift (herein deemed "undesirable" chips) was recorded to quantify the capability of the particular tube configuration to inhibit product rotation. After repeated tests, the unflared splined feed tube produced the fewest undesirable chips from round potatoes, followed closely by the flared unsplined tubes. All tube configurations were deemed to perform far better than prior art slicing machines.

Figure 5:
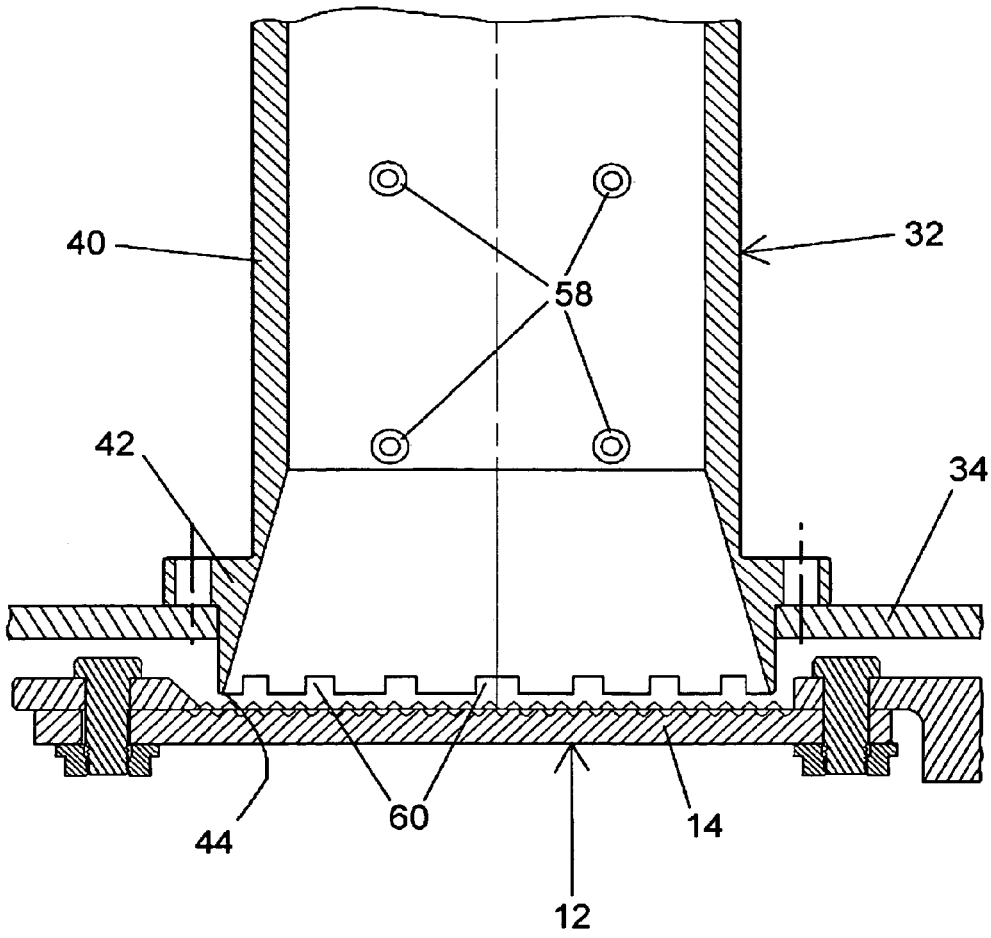
FIG. 5 is a detailed cross-sectional side view of a feed tube of the type shown in FIGS. 1 through 3, modified to include notches along its lower extremity in accordance with the present invention.

According to an additional aspect of the invention, any one or more of the feed tubes described above may be equipped with means to expel stones that are larger than the distance between the opening 44 and the cutting wheel 12. For example, a series of notched openings 60 can be formed along the opening 44 of the tube 32 to provide clearance for small stones, as shown in FIG. 5. Alternatively or in addition, the extremity of the lower portion 42 of the tube 32 that defines the opening 44 may have a sufficiently thin wall thickness that, in combination with the material from which the tube 32 is formed, is elastically or plastically deformed when a stone is encountered so as to allow the stone to be eliminated from the surface of the cutting wheel 12 surrounded by the tube opening 44, thus sparing damage to the cutting wheel 12. In this embodiment, all or part of the lower portion 42 of the tube 32 could be defined by a replaceable insert (not shown) for reduced cost and maintenance.

According to an additional aspect of the invention, any one or more of the feed tubes described above may be equipped with means to expel stones that are larger than the distance between the opening 44 and the cutting wheel 12. For example, a series of notched openings 60 can be formed along the opening 44 of the tube 32 to provide clearance for small stones, as shown in FIG. 5. Alternatively or in addition, the extremity of the lower portion 42 of the tube 32 that defines the opening 44 may have a sufficiently thin wall thickness that, in combination with the material from which the tube 32 is formed, is elastically or plastically deformed when a stone is encountered so as to allow the stone to be eliminated from the surface of the cutting wheel 12 surrounded by the tube opening 44, thus sparing damage to the cutting wheel 12. In this embodiment, all or part of the lower portion 42 of the tube 32 could be defined by a replaceable insert (not shown) for reduced cost and maintenance.

In FIG. 6, the platform 34 supporting the feed tube 32 is omitted for clarity, providing a plan view showing the relationship between the feed tube 32 and the cutting wheel 12. In combination with the aforementioned water jets 52, the feed tube 32 may be equipped with means to dissipate fluid energy when the water jets 52 impact the feed tube 32 above and below adjacent food products, which momentarily occurs when single feeding a product. A suitable dissipating means is a perforated V-shaped sleeve insert 62 shown in FIG. 6. The sleeve insert 62 is adapted for placement against the wall 48 of the feed tube 32 so that the water jets 52 are directed at a base 64 of the V-shape. When a product clears one or more water jets 52 while traveling downward through the feed tube 32 (e.g., during singulated feeding as opposed to continuous or flood feeding), the fluid of the jets 52 enters one or more openings 66 in the insert 62, and is then dissipated behind the insert 62 through bypass passages 68 defined between the legs 70 of the insert 62 and the wall 48 of the tube 32. As such, water ricocheting off the tube wall 48 does not push the product away from the tube wall 48 (toward the water jets 52). In view of its intended function, it is foreseeable that other shaped inserts could be used, or the feed tube 32 could be formed to have a double wall construction with one or more perforations in the more inward of the two walls. The insert 62 can also be configured as the aforementioned replaceable insert to provide the stone-passing function described above.

According to another preferred aspect of the invention, the cutting wheel 12 does not require tools for replacement. Instead, the cutting wheel 12 is trapped between the movable platform 34 on which the feed tube 32 is mounted and a wheel support 72 of the motor 30, on which the cutting wheel 12 is mounted. A force is applied to the cutting wheel 12 by the platform 34 through a bearing cap comprising a miniature large diameter thrust bearing 74 that is removably mounted to the upper surface of the cutting wheel 12, e.g., fitted to the hub 16 of the wheel 12 as shown in FIGS. 1 and 2. As shown, the outer edge of the platform 34 and the upper rim of the enclosure 28 have mutually tapered mating edges that align the platform 34 with the enclosure 28 as the platform 34 is lowered onto the enclosure 28 with a crank mechanism 76. The cutting wheel 12 is vertically located within the enclosure 28 such that the center of the platform 34 is deflected a controlled distance downward when the platform 34 and enclosure 28 are mated and forced together with the crank mechanism 76. In this manner, the apparatus 10 does not require fasteners to secure the cutting wheel 12 to the motor 30, as is conventionally done, such that replacement of the wheel 12 is greatly simplified.

As also depicted in FIGS. 1 and 2, a clutch assembly 78 is preferably provided between the cutting wheel 12 and the wheel support 72 to permit rotational movement of the wheel 12 relative to the support 72 under conditions in which the rotation of the wheel 12 is interfered with, such as when a large foreign object suddenly prevents the wheel 12 from rotating. As depicted, the clutch assembly 78 comprises at least one (e.g., three) spring-loaded ball plunger 80 engaged with a detent pocket (indentation) 82 in the surface of the wheel support 72, providing a slip-clutch engagement therebetween. The ball plungers 80 are biased by sufficient spring pressure to withstand normal load requirements for the wheel 12, but designed to yield when encountering forces produced by foreign objects. Each ball plunger 80 is radially aligned with one of the detent pockets 82, which are preferably part of an annular pattern of pockets 82 on the face of the wheel support 72. The presence of multiple pockets 82 allows for a large number of placement positions and self-alignment between the wheel 12 and the wheel support 72. The wheel support 72 is preferably formed of a hard material so as to minimize damage to the pockets 82 when slippage occurs.

While the invention has been described in terms of a preferred embodiment, it is apparent that other forms could be adopted by one skilled in the art. Therefore, the scope of the invention is to be limited only by the following claims.

The invention claimed is:

1. An apparatus for cutting food product in a substantially horizontal plane, the apparatus comprising:

cutting means oriented to make a substantially horizontal cut through a food product being delivered to the cutting means in a substantially vertical direction;

a housing above the cutting means and defining a passage with an opening in proximity to the cutting means for delivering the food product to the cutting means in a substantially vertical direction, the housing having an upper portion and a lower portion immediately below the upper portion, the upper portion having a first wall region with a radius of curvature in a horizontal plane, the lower portion having a lower extremity that defines the opening of the passage, the lower portion having a flared region along at least a circumferential portion thereof that is axially aligned with the first wall region, the flared region having a radius of curvature in a horizontal plane that increases in a direction away from the upper portion so that at least a portion of the opening of the passage is defined by the flared region and has a larger radius of curvature than the first wall region of the upper portion; and means for applying a force on the food product traveling downward through the passage, the force-applying means applying the force across the passage so as to urge the food product toward and into contact with the flared region of the lower portion as the cutting means is making a substantially horizontal cut through the food product.

2. An apparatus according to claim 1, wherein the flared region of the lower portion is continuous along the circumference of the passage within the lower portion so that the lower portion increases in diameter in the direction away from the upper portion.

3. An apparatus according to claim 2, wherein the flared region has a continuous frustroconical shape throughout the lower portion.

4. An apparatus according to claim 2, wherein the flared region comprises a plurality of axially-aligned circumferential surfaces having diametrical steps therebetween.

5. An apparatus according to claim 1, wherein the upper portion has splines disposed on the first wall region thereof and oriented substantially parallel to the passage.

6. An apparatus according to claim 1, wherein the opening is a first distance from the cutting means and the flared region of the lower portion comprises means for permitting a stone that has a dimension larger than the first distance to pass between the opening and the cutting means.

7. An apparatus according to claim 6, wherein the permitting means comprises notches in the lower extremity of the lower portion.

8. An apparatus according to claim 1, wherein the force applying means comprises at least two fluid jets flowing across the passage toward the first wall region so as to impact the food product as the food product travels downward through the passage.

9. An apparatus according to claim 8, wherein the at least two fluid jets converge toward the first wall region of the passage.

10. An apparatus according to claim 9, wherein the cutting means comprises blades that pass beneath the opening in a direction toward an exit point of the flared region below the first wall region of the upper portion, and the fluid jets intersect directly above the exit point.

11. An apparatus according to claim 9, further comprising a wall member within the upper portion of the passage and adjacent the first wall region thereof, the wall member and the first wall region defining a bypass flow region therebetween, the wall member spacing the food product from the first wall region as the food product is urged toward the first wall region by the at least two fluid jets, the wall member having an opening located therein so that fluid from at least one of the at least two fluid jets enters the bypass flow region if food product is not impacted by the at least one jet.

12. An apparatus according to claim 1, wherein the upper portion of the housing has a second wall region diametrically opposite the first wall region, the cutting means comprises blades that pass beneath the opening of the housing in a direction toward an exit point of the flared region below the first wall region, and the force applied by the force-applying means is directed across the passage from the second wall region toward a surface region of the cutting means below the first wall region and adjacent the exit point.

13. An apparatus according to claim 1, wherein the cutting means comprises a hub having a vertical axis of rotation, blades extending radially from the hub, and means for supporting and rotating the hub about its vertical axis of rotation.

14. An apparatus according to claim 13, wherein the housing is mounted to a platform adapted to be movable to a position above the cutting means, and wherein the hub and the supporting and rotating means have opposing lower and upper surfaces, respectively, the apparatus further comprising:

bearing means between the platform and the hub to permit rotation of the hub while under a load applied by the platform; and means for moving the platform toward the hub so as to clamp the bearing means therebetween and thereby clamp the hub to the supporting and rotating means.

15. An apparatus according to claim 14, further comprising a clutch assembly between the lower and upper surfaces of, respectively, the hub and the supporting and rotating means, the clutch assembly comprising at least one detent member biased into engagement with at least one recess so as to mechanically connect the hub and the supporting and rotating means, one of the detent member and the recess being carried by the lower surface of the hub and another of the detent member and the recess being carried by the upper surface of the supporting and rotating means, the detent member being dislodged from the recess to mechanically disconnect the hub from the supporting and rotating means if the hub is prevented from rotating at the same speed as the supporting and rotating means.

16. An apparatus according to claim 13, wherein each of the blades has a cutting edge that produces a crinkled or V-slice as the blade makes a horizontal cut through the food product being delivered to the cutting means in a substantially vertical direction.

17. An apparatus according to claim 16, wherein each of the blades has grooves that extend to and define the cutting edge, the grooves having peaks that flatten in height and valleys that increase in depth in the plane of the blade in a direction away from the cutting edge.

18. An apparatus for cutting food product in a substantially horizontal plane, the apparatus comprising:

a cutting means oriented to make a substantially horizontal cut through a food product being delivered to the cutting means in a substantially vertical direction;

a housing above the cutting means and defining a passage with an opening in proximity to the cutting means for delivering the food product to the cutting means in a substantially vertical direction, the housing having an upper portion and a lower portion immediately below the upper portion, the upper portion having a first wall region with a radius of curvature in a horizontal plane, the lower portion having a lower extremity that defines the opening of the passage, the lower portion having a flared region along at least a circumferential portion thereof that is axially aligned with the first wall region, the flared region having a radius of curvature in a horizontal plane that increases in a direction away from the upper portion so that at least a portion of the opening of the passage is defined by the flared region and has a larger radius of curvature than the first wall region of the upper portion; and means for applying a force on the food product traveling downward through the passage so as to urge the food product toward the flared region of the lower portion as the cutting means is making a substantially horizontal cut through the food product;

wherein the flared region of the lower portion is continuous along the circumference of the passage within the lower portion so that the lower portion increases in diameter in the direction away from the upper portion; and wherein the flared region comprises a plurality of axially-aligned circumferential surfaces having diametrical steps therebetween.

19. An apparatus according to claim 18, wherein the upper portion has splines disposed on the first wall region thereof and oriented substantially parallel to the passage.

20. An apparatus according to claim 18, wherein the opening is a first distance from the cutting means and the flared region of the lower portion comprises means for permitting a stone that has a dimension larger than the first distance to pass between the opening and the cutting means.

21. An apparatus according to claim 20, wherein the permitting means comprises notches in the lower extremity of the lower portion.

22. An apparatus according to claim 20, wherein the permitting means comprises a thinned wall section in the lower extremity of the lower portion, the thinned wall sections being sufficiently thin to be deformable by a stone trapped between the lower portion and the cutting means.

* * * * *